US005758934A

United States Patent [19]

Flutka et al.

[11] Patent Number: 5,758,934

[45] Date of Patent: Jun. 2, 1998

[54] COMPUTER MONITOR SUPPORT

[75] Inventors: Joseph R. Flutka, Columbia; David P. Zeitchik, North Potomac, both of Md.

[73] Assignee: Crown Furniture Manufacturing, Inc., Laurel, Md.

[21] Appl. No.: 689,646

[22] Filed: Aug. 12, 1996

[51] Int. Cl.[6] ..... A47B 81/00

[52] U.S. Cl. ..... 312/223.3; 108/50.01; 248/917; 312/194

[58] Field of Search ..... 312/194, 223.3, 312/7.2, 208.1, 223.6; 108/50.01, 25, 26, 50.02; 248/917, 920, 287.1

[56] References Cited

U.S. PATENT DOCUMENTS

| | | | |
|---|---|---|---|
| 2,676,860 | 4/1954 | Lemos | 312/194 X |
| 3,413,053 | 11/1968 | Featherston | 312/194 X |
| 4,002,831 | 1/1977 | Aeschliman | 312/7.2 X |
| 4,640,199 | 2/1987 | Zigman | 312/223.3 X |
| 4,669,789 | 6/1987 | Pemberton . | |
| 4,829,725 | 5/1989 | Gustaveson et al. | 312/7.2 X |
| 5,118,172 | 6/1992 | Ugalde | 108/102 X |
| 5,120,117 | 6/1992 | Williams . | |
| 5,199,773 | 4/1993 | Price, Jr. et al. | 312/208.1 X |
| 5,437,235 | 8/1995 | Randolph | 108/25 |
| 5,480,224 | 1/1996 | Ugalde . | |
| 5,501,420 | 3/1996 | Watt et al. | 248/920 X |

FOREIGN PATENT DOCUMENTS

| | | | |
|---|---|---|---|
| 459714 | 5/1928 | Germany | 312/208.1 |
| 6133822 | 5/1994 | Japan | 108/42 |

OTHER PUBLICATIONS

Doug Mockett & Company, Inc.; Wire Access Grommets, Wire Management Systems, Table Legs, Drawer Pulls and other fine furniture components . . . featuring The Computer Tub; 1993/4; Title page and pp. 4 & 5.

*Primary Examiner*—Peter M. Cuomo
*Assistant Examiner*—Janet M. Wilkens
*Attorney, Agent, or Firm*—Donald A. Kettlestrings

[57] ABSTRACT

Apparatus for holding a computer monitor in position for optimal viewing with respect to a horizontal work surface and adapted to matingly fit with an opening formed in the work surface includes a support for holding the monitor in a recessed and tilted position with respect to the work surface and a mechanism cooperating with the support for accommodating monitors of different sizes and for adjusting the position of the monitor for maximum viewer comfort.

27 Claims, 2 Drawing Sheets

COMPUTER MONITOR SUPPORT

BACKGROUND OF THE INVENTION

This invention relates to computer monitor supports and more particularly to a support for holding a computer monitor in an adjustable recessed and tilted position for optimal viewing with respect to a work surface and for enabling a computer keyboard to be conventionally adjustably positioned in a stored location beneath the support.

Personal computers and computer monitors are now widely used in business, education and home environments. Although computers have provided many significant benefits, their use has created some problems for the computer operator.

One problem associated with use of a computer and computer monitor is neck and back strain caused by the physical relationship between the computer monitor and the computer operator.

In the conventional upright monitor position, the computer operator must sit in an uncomfortable position to read the monitor screen. Use of the computer and the computer monitor for extended periods of time can result in back and neck fatigue and strain.

Computer monitors have also been positioned completely below the work surface of a desk or table and a piece of smoked glass allows the work surface to be used as a writing surface. This can allow for a more comfortable viewing of the monitor by the operator, but glare is increased from reflections on the glass and visibility through the extra glass can be difficult.

In an educational or teaching environment, the conventional upright position of the computer monitor can also interfere with the line of sight between the instructor and his or her students.

A computer operator frequently will need to look at written materials located on the operator's desk or work surface and to look back and forth between the computer monitor and the written materials on the work surface. If the computer monitor is located in the conventional upright position, muscle strain and eye strain can result when the operator repeatedly looks back and forth between the upright computer monitor and the written materials located on the horizontal work surface.

Many computer desks and tables provide computer keyboard drawers or supports that can be adjusted from a working position to a stored position within or beneath the desk or table work surface, and it is important that this feature be maintained when the monitor is held in a recessed and tilted position with respect to the work surface.

It is, therefore, an object of the present invention to provide a support for holding a computer monitor in a recessed and tilted position for optimal viewing with respect to a horizontal work surface.

Another object is to provide such a support which includes a mechanism for adjusting the position of the computer monitor for maximum viewer comfort and to accommodate monitors of different sizes.

A further object of the invention is the provision of such a computer monitor support which enables positioning of the computer monitor to reduce neck, back and eye strain.

Still another object is to provide such a support which holds a computer monitor in a recessed position with respect to a horizontal work surface so as to provide for an unimpeded forward line of sight by the computer operator.

Another object is to provide such a support which is configured with a downwardly sloped floor from front to back to enable a computer keyboard to be conventionally adjustably positioned beneath the support in a stored position.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides apparatus for holding a computer monitor in position for optimal viewing with respect to a horizontal work surface and adapted to matingly fit within an opening formed in the work surface, the apparatus comprising: means for supporting the monitor in a recessed and tilted position with respect to the work surface; and means in operative relationship with the supporting means for accommodating monitors of different sizes and for adjusting the position of the monitor for maximum viewer comfort.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
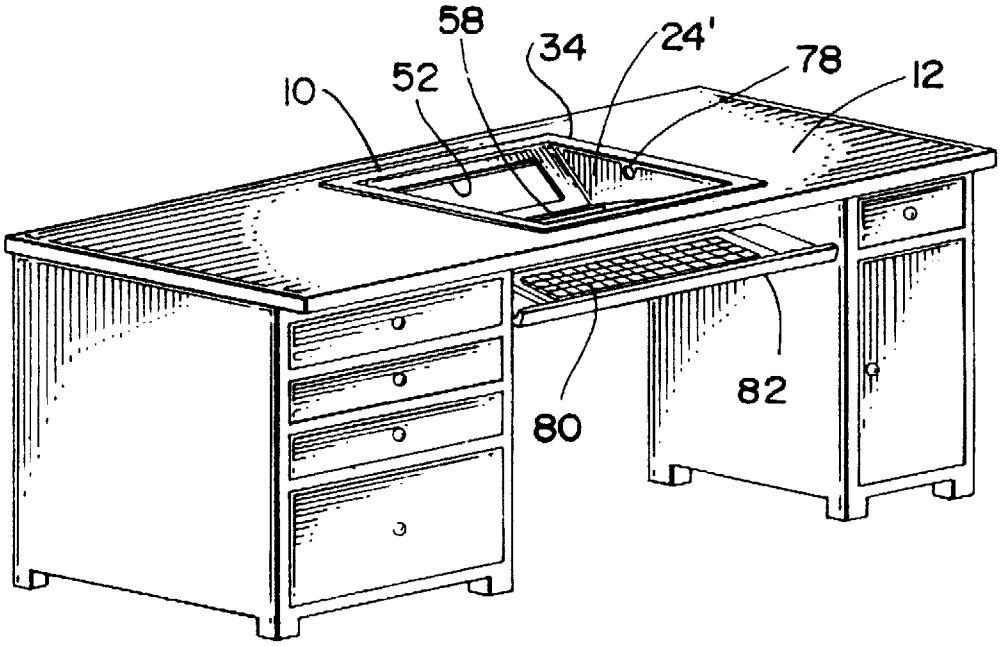
FIG. 1 is a perspective view of the computer monitor support showing the support positioned for use with a conventional computer desk.
Figure 2:
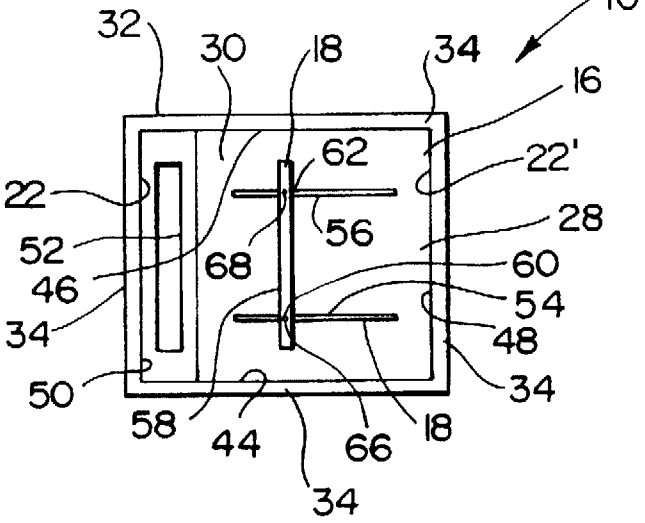
FIG. 2 is a top plan view of the computer monitor support.
Figure 4:
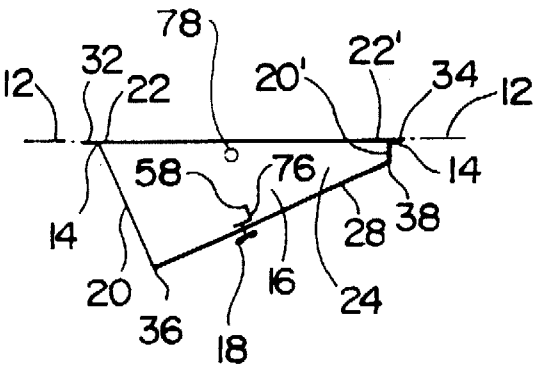
FIG. 4 is a side elevation view of the support.
Figure 5:
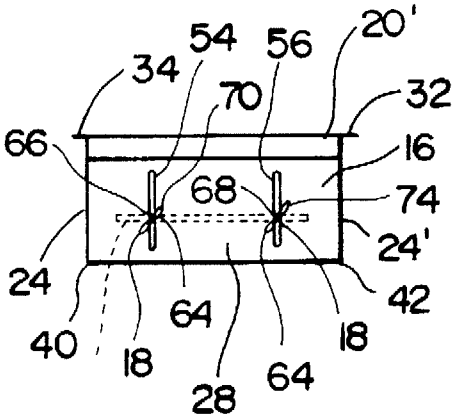
FIG. 5 is a second end elevation view of the support.
Figure 3:
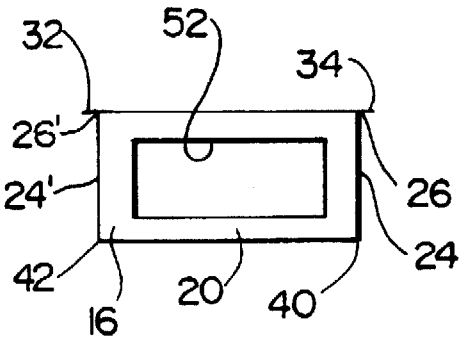
FIG. 3 is a first end elevation view of the support.

With reference now to the drawings, wherein like reference characters designate like or corresponding parts throughout the several views, there is shown apparatus 10 for holding a computer monitor (not shown) in position for optimal viewing with respect to a horizontal work surface 12, such as a desk or table, and adapted to matingly fit within an opening 14 formed in work surface 12.

Apparatus 10 includes means generally indicated at 16 for supporting the computer monitor in a recessed and tilted position with respect to work surface 12.

Apparatus 10 further includes means generally indicated at 18 in operative relationship with supporting means 16 for accommodating monitors of different sizes and for adjusting the position of the monitor for maximum viewer comfort.

In accordance with the invention, supporting means 16 include first and second opposed end walls 20, 20', respectively, defining first and second upper edges 22, 22', respectively.

Apparatus 10 further includes third and fourth opposed side walls 24, 24', respectively, connected to and extending between end walls 20, 20' and defining third and fourth upper edges 26, 26', respectively. Side walls 24, 24' are each preferably formed in the shape of a trapezium.

Apparatus 10 further includes a floor 28 connected to and extending between walls 20, 20', 24 and 24' to define a computer monitor-receiving cavity 30.

Apparatus 10 also includes means generally indicated at 32 in operative relationship with walls 20, 20', 24 and 24' for holding apparatus 10 in position with respect to work surface 12 while apparatus 10 is matingly fitted into opening 14. Holding means 32 preferably include a flange 34 connected to and projecting outwardly with respect to cavity 30 from edges 22, 22', 26 and 26' for resting on work surface 12 when apparatus 10 is matingly fitted into opening 14.

Floor 28 preferably meets first end wall 20 at substantially a right angle at junction 36 , and floor 28 preferably meets second end wall 20' at an obtuse angle at junction 38. Floor 28 meets side walls 24, 24' at right angles along junctions 40, 42, respectively.

Flange 34 is joined with and meets side walls 24, 24' and second end wall 20' at right angles along upper edges 26, 26' and 20', respectively. Flange 34 is joined with and meets first end wall 20 at an obtuse angle along upper edge 22.

First end wall 20 preferably defines an opening 52 therein for receiving and passing electrical cables (not shown) therethrough which are connected to the monitor (not shown) positioned within cavity 30.

Adjusting means 18 are preferably provided in operative relationship with floor 28 for adjusting the position of the computer monitor of for accommodating monitors of different sizes. More specifically, adjusting means 18 preferably include first and second elongated, slotted and parallel openings 54, 56 defined within floor 28 and positioned in parallel relationship with side walls 24, 24'. Adjusting means 18 further include a bar 58 defining first and second holes 60, 62 therein and fastening means generally indicated at 64 in operative relationship with openings 54, 56 and with holes 60, 62 for enabling bar 58 to be adjustably and fixedly positioned along the lengths of openings 54, 56 so that the position of the computer monitor resting on floor 28 and against bar 58 can be adjusted for the operator's comfort. Adjustment of the position of bar 58 also enables apparatus 10 to accommodate monitors of different sizes.

Fastening means 64 preferably include first and second threaded bolts 66, 68 extending through holes 60, 62 , respectively, and through openings 54, 56, respectively. Fastening means 64 also preferably include first and second nuts 70, 74 threadably engaging bolts 66, 68, respectively.

Bar 58 preferably defines an L-shaped cross section, and upright portion 76 of bar 58 is positioned at a right angle with respect to floor 28 to rest against and support the computer monitor. It is preferred that end wall 20 meet floor 28 at a right angle at junction 36, as previously described, so that the back of the computer monitor will rest against wall 20 in a stable manner if bar 58 is removed from apparatus 10.

Holding means 32 preferably further include holes 78 in side walls 24, 24' positioned to enable screws (not shown) to be inserted through holes 78 and into the desk or table to further hold apparatus 10 within opening 14.

Apparatus 10 may be made of metal or plastic. If metal is used, furniture grade sheet metal free wrinkles and other imperfections is preferred. The material is conventionally sheared to size and holes punched on computer numerically controlled (CNC) punching equipment. The bending of the flat sheet metal is then performed using brakes with computer numerically controlled (CNC) back gauge systems. The sides and end of apparatus 10 are fitted together after bending and are tack welded together prior to normal welding. The welding is a metal inert gas shielded process that produces a strong, yet neat and clean, weld. After welding and grinding, apparatus 10 is ready for coating. The coating is epoxy powder that is sprayed electrostatically onto apparatus 10 Apparatus 10 is then placed into a furnace which melts the powder which then adheres to the apparatus.

In operation and use, opening 14 is conventionally formed in horizontal work surface 12 for matingly receiving support or apparatus 10 therein. The size of opening 14 is such that flange 34 will rest upon work surface 12 to support apparatus 10 within opening 14.

The position of bar 58 along the lengths of openings 54, 56 can be adjusted by means of bolts 66, 68 and nuts 70, 74 so that the computer monitor will be located within apparatus 10 for maximum viewer comfort.

The computer monitor is positioned within apparatus 10 to rest on floor 28 and against upright portion 76 of bar 58. In this manner, the computer monitor is held in a recessed and tilted position with respect to work surface 12. Cables leading to and from the computer monitor are positioned through opening 52 of apparatus or support 10

The sloped configuration of floor 28 from wall 20' downwardly to wall 20 also enables the computer keyboard 80 to be located beneath apparatus 10 and beneath floor 28 when the keyboard is conventionally placed into a stored position by a keyboard drawer or support 82.

The invention in its broader aspects is not limited to the specific details shown and described, and departures may be made from such details without departing from the principles of the invention and without sacrificing its chief advantages.

What is claimed is:

1. Apparatus for holding a computer monitor in position for optimal viewing with respect to a work surface and adapted to matingly fit within an opening formed in the work surface, said apparatus comprising:

means defining a fixed, unmovable floor and for supporting said monitor in a recessed and tilted position with respect to said work surface; and means in operative relationship with said supporting means for adjusting the position of said monitor in substantially parallel relationship with and along said floor for maximum viewer comfort and for accommodating monitors of different sizes within said opening.

2. Apparatus as in claim 1 wherein said adjusting means include:

first and second elongated and substantially parallel openings defined within said floor;

a bar defining first and second holes therein; and fastening means in operative relationship with said first and second openings and said holes for enabling said bar to be adjustably and fixedly positioned along said first and second openings, whereby monitors of different sizes can be accommodated within said work surface opening and the position of said monitor resting on said floor and against said bar can be adjusted for the monitor viewer's comfort.

3. A support as in claim 2 wherein said fastening means include:

first and second threaded bolts extending through said first and second holes and through said first and second openings, respectively; and first and second nuts threadably engaging said first and second bolts, respectively.

4. A support as in claim 3 wherein said bar defines a substantially L-shaped cross section.

5. A support for holding a computer monitor in a recessed and tilted position for optimal viewing with respect to a work surface and adapted to matingly fit within an opening formed in the work surface, said support comprising:

first and second opposed end walls defining first and second upper edges, respectively;

third and fourth opposed side walls connected to and extending between said first and second end walls and defining third and fourth upper edges, respectively;

a floor connected to and extending between said first, second, third and fourth walls to define a monitor-receiving cavity;

means in operative relationship with said first, second, third and fourth walls for holding said support in position with respect to said work surface while said support is fitted into said opening;

wherein said holding means include a flange connected to and projecting outwardly with respect to said cavity from said first, second, third and fourth edges for resting on said work surface; and further including means in operative relationship with said floor for adjusting the position of said computer monitor in substantially parallel relationship with and along said floor and for accommodating monitors of different sizes within said cavity.

6. A support as in claim 5 wherein said side walls are each formed in the shape of a trapezium.

7. A support as in claim 6 wherein said floor meets said first end wall at substantially a right angle.

8. A support as in claim 7 wherein said floor meets said second end wall at an obtuse angle.

9. A support as in claim 8 wherein said floor meets said side walls at substantially right angles.

10. A support as in claim 9 wherein said flange meets said side walls and said second end wall at substantially right angles.

11. A support as in claim 10 wherein said flange meets said first end wall at an obtuse angle.

12. A support as in claim 11 wherein said first end wall defines an opening therein for receiving and passing electrical cables therethrough which are connected to said monitor posi- tioned within said cavity.

13. A support as in claim 5 wherein said adjusting means include:

first and second elongated and substantially parallel openings defined within said floor and positioned substantially parallel with said side walls;

a bar defining first and second holes therein; and fastening means in operative relationship with said openings and said holes for enabling said bar to be adjustably and fixedly positioned along said first and second openings, whereby monitors of different sizes can be accommodated within said cavity and the position of said monitor resting on said floor and against said bar can be adjusted for the monitor viewer's comfort.

14. A support as in claim 13 wherein said fastening means include:

first and second threaded bolts extending through said first and second holes and through said first and second openings, respectively; and first and second nuts threadably engaging said first and second bolts, respectively.

15. A support as in claim 14 wherein said bar defines a substantially L-shaped cross section.

16. A computer monitor support system holding a computer monitor in a recessed and tilted position for optimal viewing and including a support and a work surface defining an opening matingly receiving said support therein; and said support comprising:

first and second opposed end walls defining first and second upper edges, respectively;

third and fourth opposed side walls connected to and extending between said first and second end walls and defining third and fourth upper edges, respectively;

a floor connected to and extending between said first, second, third and fourth walls to define a monitor-receiving cavity;

means in operative relationship with said first, second, third and fourth walls for holding said support in position with respect to said work surface while said support is fitted into said opening;

wherein said holding means include a flange connected to and projecting outwardly with respect to said cavity from said first, second, third and fourth edges resting on said work surface; and further including means in operative relationship with said floor for adjusting the position of said computer monitor in substantially parallel relationship with and along said floor and for accommodating monitors of different sizes within said cavity.

17. A computer monitor support system as in claim 16 wherein said flange meets said first end wall at an obtuse angle.

18. A computer monitor support system as in claim 17 wherein said first end wall defines an opening therein for receiving and passing electrical cables therethrough which are connected to said monitor positioned within said cavity.

19. A computer monitor support system as in claim 16 wherein said adjusting means include:

first and second elongated and substantially parallel openings defined within said floor and positioned substantially parallel with said side walls;

a bar defining first and second holes therein; and fastening means in operative relationship with said openings and said holes for enabling said bar to be adjustably and fixedly positioned along said first and second openings, whereby monitors of different sizes can be accommodated within said cavity and the position of said monitor resting on said floor and against said bar can be adjusted for the monitor viewer's comfort.

20. A computer monitor support system as in claim 19 wherein said fastening means include:

first and second threaded bolts extending through said first and second holes and through said first and second openings, respectively; and first and second nuts threadably engaging said first and second bolts, respectively.

21. A computer monitor support system as in claim 20 wherein said bar defines a substantially L-shaped cross section.

22. A computer monitor support system holding a computer monitor in position for optimal viewing, said system comprising:

apparatus holding said computer monitor, and a work surface defining an upper surface and an opening within said upper surface matingly receiving said apparatus therein, and wherein said apparatus comprises:

means resting on said upper surface and defining a fixed, unmovable floor for supporting said monitor in a recessed and tilted position with respect to said work surface; and means in operative relationship with said supporting means for adjusting the position of said monitor in substantially parallel relationship with and along said floor for maximum viewer comfort and for accommodating monitors of different sizes within said opening.

23. A system as in claim 22 wherein said adjusting means include:

first and second elongated and substantially parallel openings defined within said floor;

a bar defining first and second holes therein; and fastening means in operative relationship with said first and second openings and said holes for enabling said bar to be adjustably and fixedly positioned along said first and second openings, whereby monitors of different sizes can be accommodated within said work surface opening and the position of said monitor resting on said floor and against said bar can be adjusted for the monitor viewer's comfort.

24. A system as in claim 23 wherein said fastening means include:

first and second threaded bolts extending through said first and second holes and through said first and second openings, respectively; and first and second nuts threadably engaging said first and second bolts, respectively.

25. A system as in claim 24 wherein said bar defines a substantially L-shaped cross section.

26. A system as in claim 22 wherein said supporting means further include:

first and second opposed end walls defining first and second upper edges, respectively;

third and fourth opposed side walls connected to and extending between said first and second end walls and defining third and fourth upper edges, respectively;

said floor connected to and extending between said first, second, third and fourth walls to define a monitor-receiving cavity; and means in operative relationship with said first, second, third and fourth walls resting on said upper surface for holding said apparatus in position within said opening.

27. A system as in claim 26 wherein said resting means include a flange connected to and projecting outwardly with respect to said cavity from said first, second, third and fourth edges, said flange resting on said upper surface.

* * * * *